United States Patent [19]

Inohara et al.

[11] 3,969,884

[45] July 20, 1976

[54] TWISTER

[75] Inventors: Shu Inohara, Sakai; Yasuyuki Nagamune, Osaka, both of Japan

[73] Assignee: Kabushiki Kaisha Kajitekkosho, Japan

[22] Filed: Nov. 8, 1974

[21] Appl. No.: 522,126

[52] U.S. Cl. ..... 57/58.54

[51] Int. Cl.[2] ..... D01H 1/10; D01H 7/86

[58] Field of Search ..... 57/34 R, 58.54, 58.76, 57/58.49, 58.52, 58.65, 58.68

[56] References Cited

UNITED STATES PATENTS

| | | | |
|---|---|---|---|
| 2,487,838 | 11/1949 | Uhlig | 57/58.76 X |
| 2,534,496 | 12/1950 | Agresti | 57/58.76 X |
| 2,575,476 | 11/1951 | Truitt | 57/58.76 X |
| 2,654,210 | 10/1953 | Bogdanffy et al. | 57/58.76 X |
| 2,732,681 | 1/1956 | Klein | 57/58.76 X |

*Primary Examiner*—Donald E. Watkins

*Attorney, Agent, or Firm*—Stewart and Kolasch, Ltd.

[57] ABSTRACT

A twister adapted for the manufacture of cordage on which yarns are twisted in opposite directions in the continuous processes of plying and cabling, wherein the twisted yarns are finally wound on a bobbin under a constant stretching action irrespective of an increase in the outside diameter of the bobbin, thereby eliminating the necessity of doffing between the plying and the cabling processes.

2 Claims, 7 Drawing Figures

TWISTER

BACKGROUND AND SUMMARY OF THE INVENTION

The present invention relates to a twister adapted for the manufacture of twisted yarns and cordage particularly for industrial uses, wherein plying and cabling are essentially required to build up the cordage structure. More particularly, the present invention is directed to a twister on which the plying and the cabling are continuously performed without the intermediate doffing therebetween, thereby ensuring the production of cordage on a sequential process.

In the known methods, ring twisters have been used for twisting yarn, wherein the plying and cabling are performed on separate self-contained processes with the necessity of providing doffing therebetween. This is very time-consuming and laborious, and more disadvantageously, it tends to produce a waste of material yarns.

The present invention simplifies and improves the above-mentioned conventional methods utilizing ring-twisters.

In accordance with the present invention, the apparatus is provided with a number of sections individually consisting mainly of a plurality of plying double-twisting spindles and a single cabling double-twisting spindle, with the interposition of a feeding means, thereby enabling the yarns to run therethrough in a continuous manner.

BRIEF DESCRIPTION OF THE DRAWINGS

The invention will be more particularly described by way of example, with particular reference to the drawings, wherein.

DESCRIPTION OF THE PREFERRED EMBODIMENTS

Figure 1:
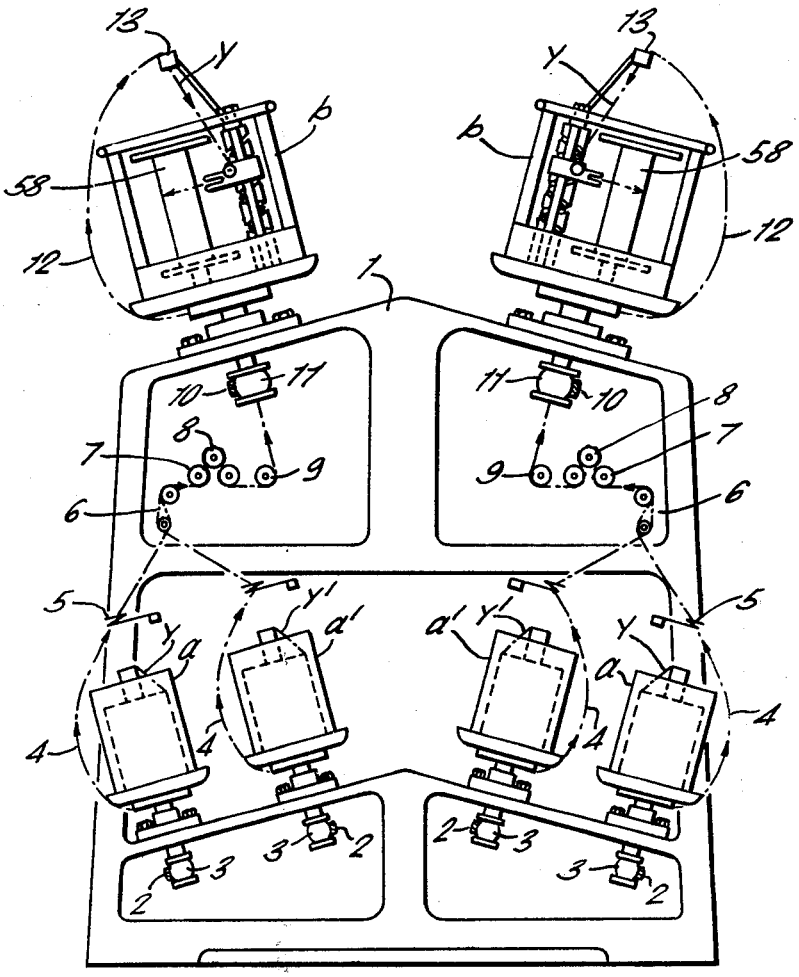
FIG. 1 is a schematic view of one form of the apparatus particularly showing sections individually consisting of two plying double-twisting spindles and a single cabling double-twisting spindle.

Referring to FIG. 1, the embodiment illustrated is provided with a mounting base 1 whose sides slope outwardly. On each side there are mounted a pair of double twisters *a* and *a'* for plying, and a single double twister *b* for cabling including a bobbin 58 therein. The bobbin 58 is capable of winding the yarn Y thereon with a constant stretch irrespective of an increase in the outside diameter of the bobbin with the winding yarns.

The yarns Y combined by a pair of tension adjuster rollers 6 are led by a feed roller 7 into the bore 24' of a hollow shaft 24 (FIG. 3) and are taken through as aperture 30 in a disc 29 up to a guide 13. A balloon 12 is formed in the yarn due to centrifugal action. The individual yarns are twisted by the respective twister 5 *a* and *a'*. In this manner the yarns Y are finally wound on the bobbin 58 by way of a second guide 78, a guide-shifter 76 and a folk-shaped guide 77. The bobbin 58 is rotated by the hollow shaft which is driven by power. As the yarns Y wind upon the bobbin 58, the outside diameter of the bobbin increases with the accumulating yarns, so that the rotating speed of the bobbin must be accordingly decreased so as to maintain the uniform winding of the yarns, which run at a constant speed. In addition, as the outside diameter of the bobbin increases, the torque of the bobbin must be proportionally increased so as to ensure a constant stretch of the yarns. If the pull upon the yarns becomes smaller than the ballooning force of the yarns, they tend to slacken around the bobbin and tangle in the disc 29. This problem is detrimental to the winding of yarns, and in most cases, results in the breakage of the yarn. In order to solve this problem, it has been proposed that the torque of the bobbin should be initially made large in anticipation of the subsequent decrease in the torque. However, this produced unfavorable effects upon the yarns because of the initial excessive torque, that is the final product has unmarketably poor quality.

The present invention has solved this problem by providing the cabling double twister *b* with a means which enables the bobbin 58 to rotate at an appropriate speed regardless of an increase in the outside diameter thereof, thereby ensuring a constant winding stretch of yarns.

Figure 3:
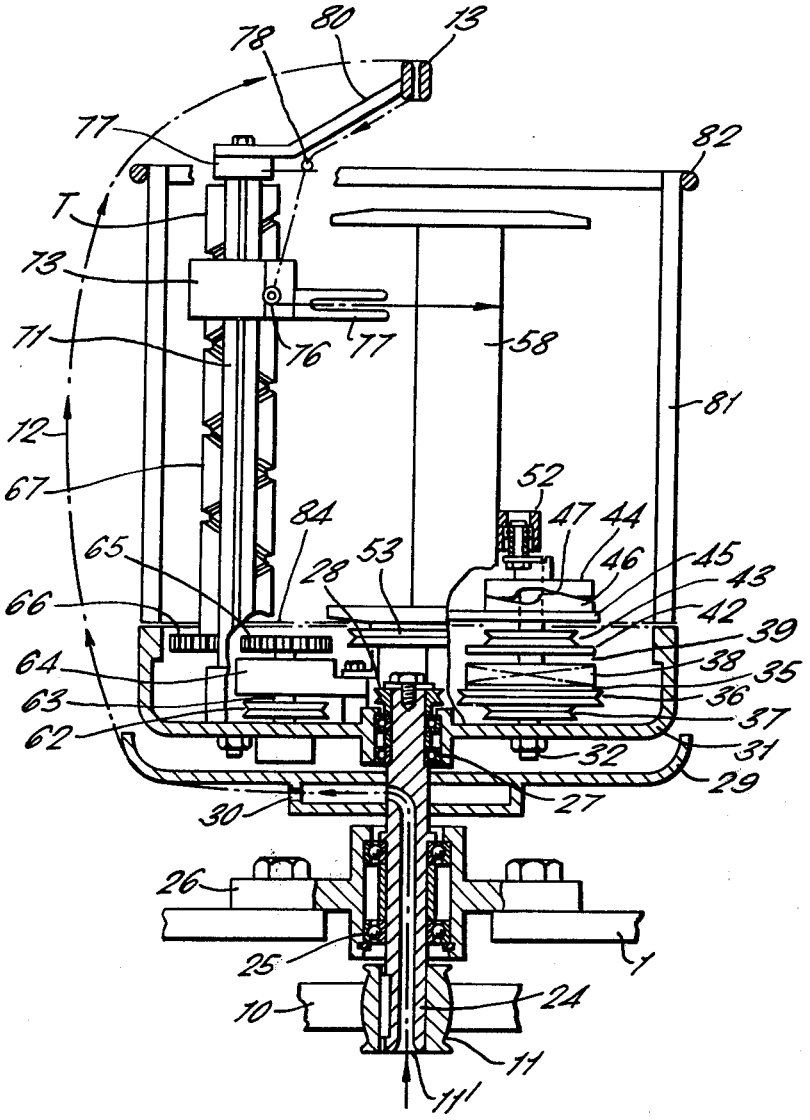
FIG. 3 is a front view of a cabling double-twisting spindle incorporated in the apparatus shown in FIG. 1.
Figure 4:
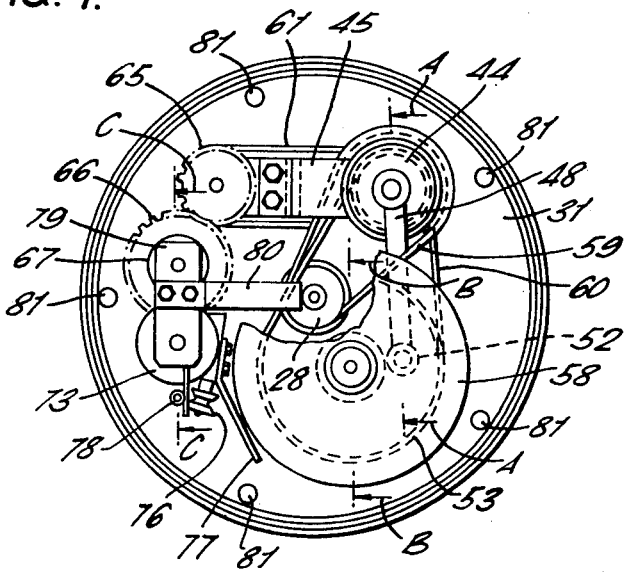
FIG. 4 is a plan view of the cabling double-twisting spindle shown in FIG. 3.
Figure 5:
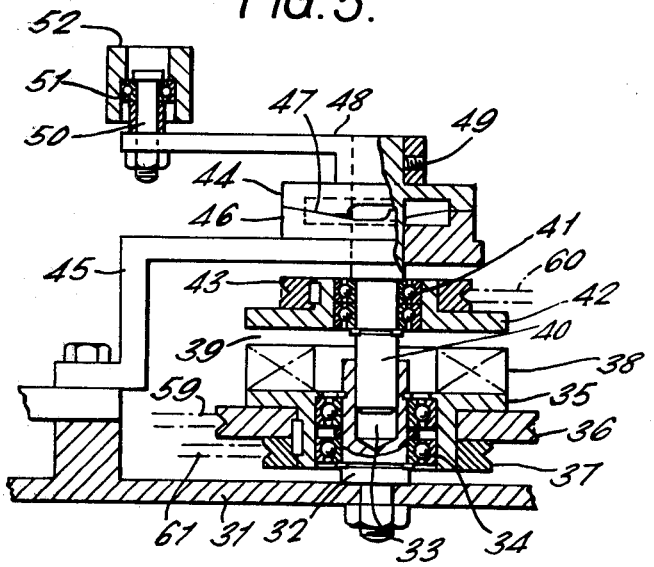
FIG. 5 is a sectional view of the cabling double-twisting spindle shown in FIG. 4, taken along the line A—A therein.

In FIGS. 3, 4 and 5 the driving force from a motor (not shown) is succesively transmitted to a belt 10, a pulley 11, the hollow shaft 24, a second pulley 28, a belt 59 and a pulley 36 rotatably supported on a shaft 32, which is intergral with a bush 35 and a pulley 37. The flanged bush 35 is rotatably supported on the shaft 32 through ball bearing 34, wherein the shaft 32 is fixed to a casing 31 and wherein the flanged bush has a permanet magnet 38 thereon. The shaft 32 includes a bore 33 in which a cam shaft 40 is movably received. The cam shaft 40 includes an upper cam 44 and a magnetizable plate 42 with a pulley 43, which, as a whole, are rotatable around the shaft 40 through ball bearing 41 when the magnet 38 is rotated. When the pulley 43 is rotated by magnetism, the drive is transmitted to the pulley 53 of the bobbin by means of a belt 60. A mating lower cam 46 is provided on a braket 45 fixed to the casing 31 (FIG. 5), in which reference numeral 47 indicates the matching surfaces of the upper and lower cams. Normally, they are closed by the magnetism. The matching surfaces are correspondingly dented, and the upper cam 44 is caused to slide on the lower cam 46 when an arm 48 (FIG. 5) is angularly moved, thereby enabling the cam shaft 40 to rise and lower in the bore 33 of the shaft 32.

The arm 48 is supported on the cam shaft 40 and provided with a roller 52 at its extreme end through a small shaft 50 and a ball bearing 51, the roller 52 being referred to as a detecting toucher hereinafter. In addition, the arm 48 is adjustable by an adjusting screw 49 with respect to the lower cam 46, so as to place both the cams 44 and 46 concentric. The detecting toucher or roller 52 is kept in contact with the yarns on the periphery of the bobbin 58 by means of a spring means (not shown) housed in place between the upper and lower cams.

The magnet 38 is constantly rotated by means of the shaft 24 through the pulleys 28 and 36 and the belt 59. The magnet 38 and the mating magnetizable plate (e.g. a steel plate) 42 are spaced apart from each other by a gap 39, which varies in size in accordance with the rise and fall of the cam shaft 40. The size of the gap 39 determines the strength of the magnetism between the magnet 38 and the mating plate 42. The smaller the gap is, the stronger the magnetic attraction becomes, thereby producing an increased torque of the bobbin 58. Thus, a constant torque can be maintained throughout the winding process irrespective of the gradual increase in the outside diameter of the bobbin due to a build-up of yarn on the bobbin.

Figure 6:
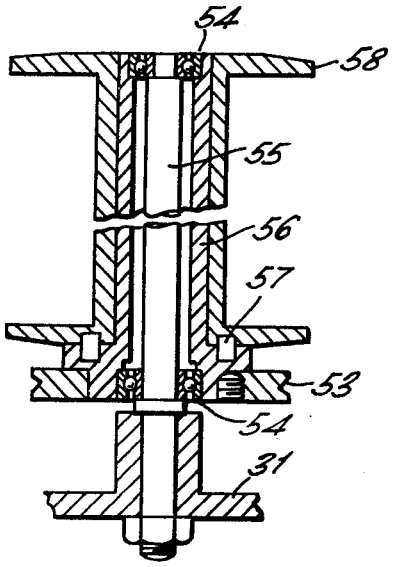
FIG. 6 is a sectional view of the cabling double-twisting spindle in FIG. 3, taken along the line B—B therein.
Figure 7:
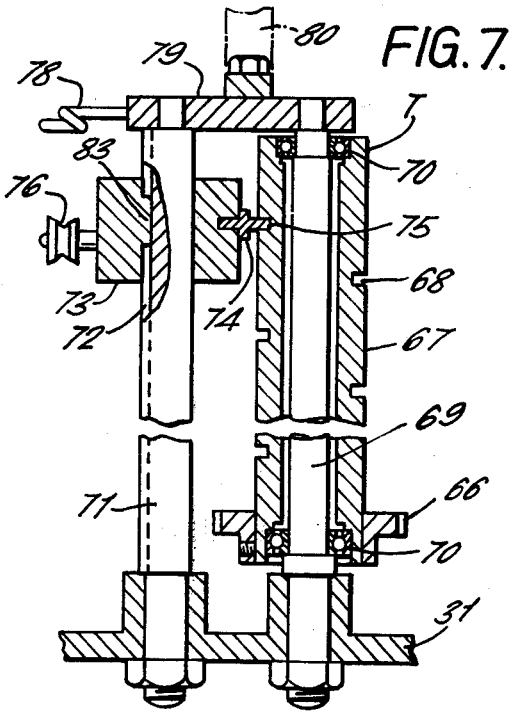
FIG. 7 is a sectional view of the cabling double-twisting spindle shown in FIG. 3, taken along the line C-C.

Referring to FIG. 6, in which the mounting of the bobbin 58 is illustrated, a bush supporter 55 is fixed to the casing 31 and supports a bush 56 rotatably through ball bearings 54. The power is transferred to the bush 56 through a pulley 53. The bobbin 58 is associated with the bush 56 by means of a locking pin 57, thereby securing a unitary motion thereof around the bush supporter 55.

Referring to FIGS. 3, 4, 5 and 7, a traveller T will be explained:

The traveller T consists essentially of a slider 73, a grooved pillar 67 and a supporter 71 for guiding the slider. The grooved pillar 67 is associated with a gear 66 and rotated by the companion gear 65, which is driven synchronously with the the magnet 38 through a pulley 37, a belt 61, a pulley 62 and a speed-reduction device 64 mounted on the shaft 63 of the pulley 62. The grooved pillar 67 is rotatably supported on a shaft 69 through ball bearing 70, wherein the shaft 69 per se is fixed to the casing 31.

The guiding supporter 71 of the slider 73 is fixed to the casing 31, and additionally, provided with a groove 72 in which a crosswise projection 83 of the slider 73 is fitted so as to enable the slider to vertically move along the groove 72. The slider 73 is provided with a roller having an edge 75, which fits in the groove 68 on the grooved pillar 67. Thus, when the grooved pillar 67 is rotated, the slider 73 is caused to move vertically along the guiding supporter 71, thereby enabling the yarn Y to be uniformly laid over the bobbin 58. This is helped by the guide-shifter 76 and the folk-shaped guide 77 in leading the running yarn Y onto the bobbin 58. The yarn Y is led to the guide-shifter 76 by way of the top guide 13 and the second guide 78. A guiding arm 80 is angularly rotatable on a ceiling plate 79, which is extended over both the grooved pillar 67 and the guiding supporter 71, so as to clear the way for the bobbin being removed. The casing 31 has an appropriate number of poles 81 erected upwardly, each of which is provided with a ring 82 intended to prevent the balloon 12 from becoming caught thereabout. The poles 81 lock a lid 84 over the casing 31, whereby the inside of the casing is protected against dust and other foreign matters.

Figure 2:
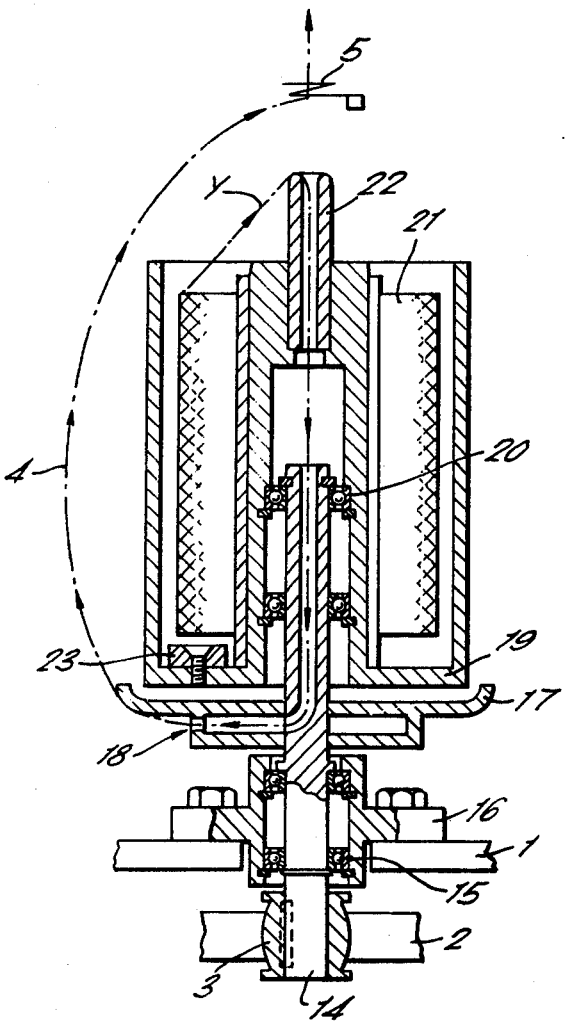
FIG. 2 is a front view of a plying double-twisting spindle incorporated in the apparatus shown in FIG. 1.

The aparatus thus constructed is operated as follows:

Referring to FIG. 2, where the plying spindle a, a′ is shown, the yarn Y is led from a supply package 21 housed in a casing 19 by the pull effected when the feed roller 7 (FIG. 1) is driven. The yarn Y is passed through a top guide 22 and then through the bore of the spindle 14. The disc 17 and the spindle 14 are rotated by means of the belt 2 and the pulley 3, and accordingly, the yarn Y is given one twist during the period when it is taken away from the aperture 18 in the disc 17. In addition, the yarn Y is twisted one more times until it reaches the snail guide 5 while forming a balloon 4. The two yarns Y and Y′ from the spindles *a* and *a′* are jointed under an equal tension adjusted by tension adjuster rollers 6, and led to the feed roller 7, with which a further roller is kept in contact so as to secure the delivery of the plied yarn to the subsequent cabling process by way of a guide roller 9. In the cabling spindles *b* and *b′* the substantially same procedure is followed so as to twist or cable the yarn further. In FIG. 3, the yarn is let into the bore 24′ of the hollow shaft or spindle 24 and fed out of an aperture 30 formed in the side of the disc 29, where the fist twist is given to the yarn. Until the yarn reaches the top guide 13, the second twist is additionally given thereto while forming a balloon 12. Subsequently, the cabled yarn is led to the slider 73 and finally wound onto the bobbin 58. The number of twists is determined, in either plying or cabling, by the rotations per minute of each spindle in relation to the running speed of the yarn, which depends on the speed of the feed roller 7. In plying Z twist is given, whereas in cabling S twist is given if the yarn is commonly rotated in the clockwise direction. This is due to the fact that in plying the yarn is introduced from the top and in cabling it is fed from the bottom.

The arrangement of the plying and cabling spindles is not limited to the embodiment illustrated; but it can be arranged in an appropriate form. For example, the plying and cabling spindles can be exchanged with each other without any substantial changes in operation and performance. In the embodiment illustrated the mounting bases of each spindle are inclined outwards; but the spindles can be mounted on a flat base, or alternatively, can be mounted in a horizontal manner. It also can be arranged that the plying spindles are grouped on one side of the base and on opposite side thereof, the cabling spindles are mounted together.

As evident from the foregoing, the twister of the present invention produces cordage on a continuous process without the necessity of doffing operation therebetween, thereby ensuring a simplified and efficient procedure in manufacturing cordage. According to the present invention, efficiency and economy are immensely enhanced by virtue of the reduced manual operation, such as doffing, and the reduced loss of material. In addition, the uniform quality of the product is secured.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for the manufacture of twisted yarns and cordage which comprises a plurality of double twisters disposed in juxtaposition with respect to each other and a single cable double twister disposed above said plurality of twisters and containing a power-driven bobbin rotatably disposed therein, means associated with said bobbin for controlling the torque in said bobbin so as to ensure a constant stretch of the yarns and a plurality of feed rollers and tension adjuster rollers disposed between said double twisters and said single cable double twister for conveying the yarn from said plurality of twisters to said single-cable double twister.

2. An apparatus for the manufacture of cordage as claimed in claim 1, wherein the bobbin includes a drive means for driving said bobbin, said drive means being divided into a driving section and a driven section, said driving section having a permanent magnet and said driven section having a mating magnetizable piece, said magnetizable piece being spaced apart from said permanent magnet by a gap disposed therebetween, said driven section having a cam means with a detecting toucher on the periphery of said bobbin whereby said gap between said magnet and said magnetizable piece is decreased in accordance with an increase in the outside diameter of said bobbin with the winding yarn.

* * * * *